US008113634B2

(12) United States Patent
Mizoguchi

(10) Patent No.: US 8,113,634 B2
(45) Date of Patent: Feb. 14, 2012

(54) RECORDING HEAD AND MANUFACTURING METHOD THEREOF

(75) Inventor: Yuji Mizoguchi, Kani (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 405 days.

(21) Appl. No.: 12/499,695

(22) Filed: Jul. 8, 2009

(65) Prior Publication Data

US 2010/0007697 A1 Jan. 14, 2010

(30) Foreign Application Priority Data

Jul. 14, 2008 (JP) ..... 2008-182466

(51) Int. Cl.
*B41J 2/045* (2006.01)

(52) U.S. Cl. ..... 347/71; 347/40; 347/65

(58) Field of Classification Search ..... 347/20, 347/40, 42, 43–49, 59, 61–71, 73, 75–76
See application file for complete search history.

(56) References Cited

U.S. PATENT DOCUMENTS

| | | | | |
|---|---|---|---|---|
| 6,513,896 | B1 * | 2/2003 | Kawamura | 347/15 |
| 7,152,952 | B2 | 12/2006 | Chikamoto | |
| 7,669,985 | B2 * | 3/2010 | Stevenson | 347/68 |
| 8,007,079 | B2 * | 8/2011 | Takahashi | 347/68 |
| 2011/0025779 | A1 * | 2/2011 | Panchawagh et al. | 347/47 |

FOREIGN PATENT DOCUMENTS

| | | | |
|---|---|---|---|
| CN | 1576010 | A | 2/2005 |
| EP | 1493582 | A1 | 1/2005 |
| JP | 2001-315344 | A | 11/2001 |
| JP | 2003-305851 | A | 10/2003 |
| JP | 2005-022183 | A | 1/2005 |

OTHER PUBLICATIONS

The State Intellectual Property Office of the People's Republic of China, Notification of First Office Action for Chinese Application No. 200910152297.2, dated Jun. 12, 2010. (Counterpart to above-captioned patent application.)

* cited by examiner

*Primary Examiner* — Thinh Nguyen
(74) *Attorney, Agent, or Firm* — Baker Botts L.L.P.

(57) ABSTRACT

A recording head includes a stacked body including: a liquid flow path; a plurality of plates stacked on each other; and two communicating holes. Each of the plurality of plates includes: a cross-sectional portion of the liquid flow path; a positioning hole; and a reference hole. Locations of the positioning hole and the reference hole of a plate of the plurality of plates correspond to locations of the reference hole and the positioning hole, respectively, of a plate adjacent to the one plate such that, when the plates are stacked, the positioning holes and the reference holes of adjacent plates alternate to communicate with each other so as to form the two communicating holes, the diameters of the positioning holes of the plurality of plates being successively smaller in order from one side to another side of the stacked body relative to a stack direction of the plurality of plates.

9 Claims, 11 Drawing Sheets

RECORDING HEAD AND MANUFACTURING METHOD THEREOF

CROSS-REFERENCE TO RELATED APPLICATIONS

This application claims priority from Japanese Patent Application No. 2008-182466 filed on Jul. 14, 2008, the entire subject matter of which is incorporated herein by reference.

TECHNICAL FIELD

Apparatuses, devices, and methods consistent with the present invention relate to recording heads and, more particularly, to recording heads having a stacked configuration.

BACKGROUND

A known inkjet head has a flow path unit formed with an ink flow path including a common ink chamber and a plurality of individual ink flow paths from the exit of the common ink chamber to a nozzle. The flow path unit has a stack structure wherein a plurality of plates are stacked on each other. Through holes formed in the plates are connected to each other, whereby an internal ink flow path is formed. An art of forming positioning holes in plates and inserting the positioning holes into positioning pins, thereby positioning the plates is known. However, in such an inkjet head, the ink flow path formed in the flow path unit is made increasingly smaller and smaller due to the demands of higher density of the nozzle and miniaturization of the inkjet head. Thus, with the dimensions of the ink flow path becoming more and more fine, the plates need to be positioned with even higher accuracy so that the through holes formed in the plates are joined precisely in a manufacturing process of the flow path unit.

SUMMARY

In the above-described inkjet head, the positioning accuracy of each plate depends on the tolerance of the inner diameter of the positioning hole formed in the plate and therefore it is difficult to position each plate with accuracy of the tolerance or less.

Therefore, illustrative aspects of the invention provide a recording head and a manufacturing method of the recording head for enabling adjacent plates to be positioned with high accuracy.

According to one illustrative aspect of the invention, there is provided a recording head comprising: a stacked body comprising: a liquid flow path; a plurality of plates stacked on each other; and a communicating hole piercing the stacked body, wherein each of the plurality of plates comprises a cross-sectional portion of the liquid flow path, such that when the plurality of plates are stacked on one another and the liquid flow path is formed, alternate ones of the plurality of plates comprise a reference hole, remaining ones of the plurality of plates comprise a positioning hole, a diameter of each of the references holes are the same, the diameter being larger than a diameter of each of the positioning holes, and the diameters of the positioning holes are successively smaller in order from one side to another side of the stacked body, and when the plates are stacked, the reference holes and the positioning holes of the plates alternate to communicate with each other to form the communicating hole.

According to another illustrative aspect of the invention, there is provided a recording head comprising: a stacked body comprising: a liquid flow path; a plurality of plates stacked on each other; and two communicating holes piercing the stacked body, wherein each of the plurality of plates comprises: a cross-sectional portion of the liquid flow path, such that when the plurality of plates are stacked on one another and the liquid flow path is formed; a positioning hole; and a reference hole, a diameter of the reference hole being larger than a diameter of the positioning hole, wherein locations of the positioning hole and the reference hole of a plate of the plurality of plates correspond to locations of the reference hole and the positioning hole, respectively, of a plate adjacent to the one plate such that, when the plates are stacked, the positioning holes and the reference holes of adjacent plates alternate to communicate with each other so as to form the two communicating holes, the diameters of the positioning holes of the plurality of plates being successively smaller in order from one side to another side of the stacked body relative to a stack direction of the plurality of plates.

According to still another illustrative aspect of the invention, there is provided a method for manufacturing the recording head according to the another aspect, the method comprising: a placing step comprising placing a new plate of the plurality of plates; a positioning step comprising: applying light through each of the two communicating holes from one side of the stacked body; picking up the light from the other side of the stacked body to form images of the two communicating holes; and performing relative positioning between the new plate and a plate placed immediately before the new plate based on the images; and a stacking step comprising stacking the new plate on the plate placed immediately before.

According to the illustrative aspects of the invention, in the placing step, the positioning hole involved in the new placed plate is accommodated in the reference hole and the positioning hole involved in the different plate placed just before that plate and the reference hole involved in the new placed plate accommodates the positioning hole involved in the different plate placed just before that plate. Thus, in the positioning step, when an image of the new placed plate is picked up while light in the direction from the one end to the opposite end is applied to the stacked body, the position of the positioning hole of the new placed plate and the position of the positioning hole of the plate placed just before that plate can be provided at the same time, as the image pickup result. Since relative positioning between the new placed plate and the plate placed just before that plate is performed based on the image pickup result, the adjacent plates can be positioned with high accuracy. Accordingly, the liquid flow path can be formed with high accuracy.

According to the illustrative aspects of the invention, in the positioning step, when an image of the new placed plate is picked up while light in the direction from the one end to the opposite end is applied to the stacked body, the position of the positioning hole of the new placed plate and the position of the positioning hole of the plate placed just before that plate can be provided at the same time, as the image pickup result. Since relative positioning between the new placed plate and the plate placed just before that plate is performed based on the image pickup result, the adjacent plates can be positioned with high accuracy. Accordingly, the liquid flow path can be formed with high accuracy.

DETAILED DESCRIPTION

Exemplary embodiments of the invention will now be described with reference to the drawings.

Figure 1:
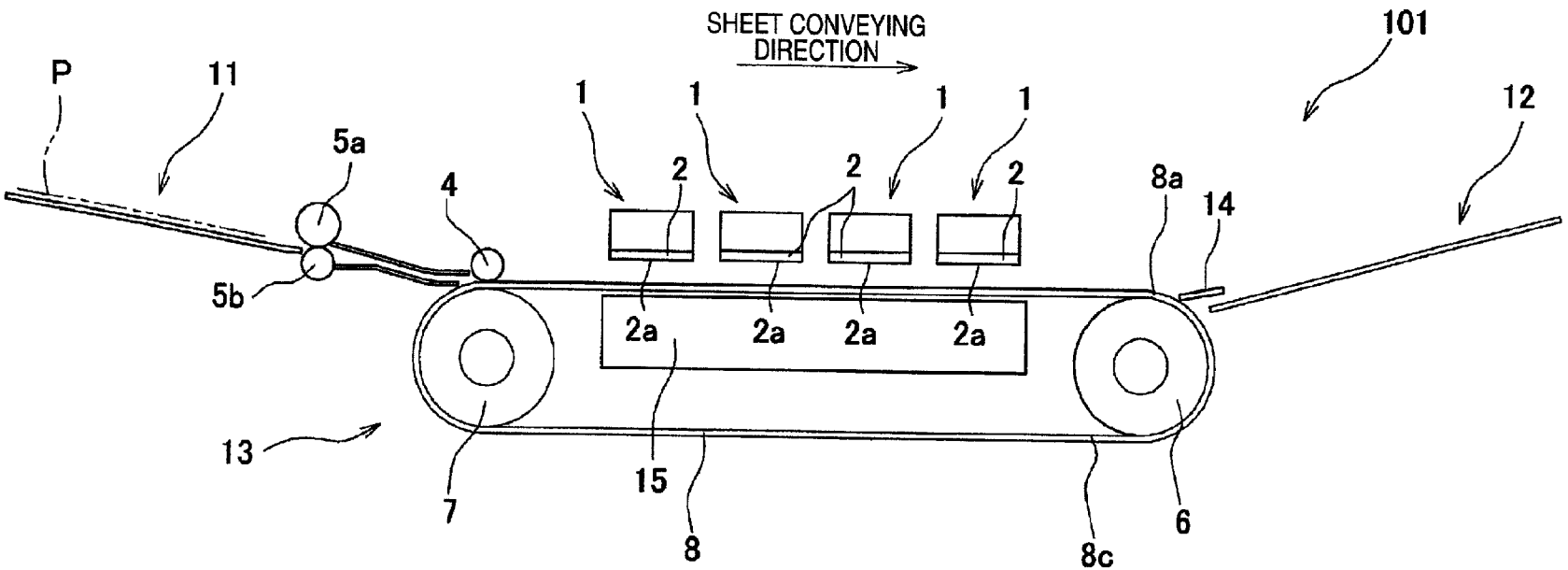
FIG. 1 is a schematic side view of an inkjet printer according to an exemplary embodiment of the invention.
Figure 2:
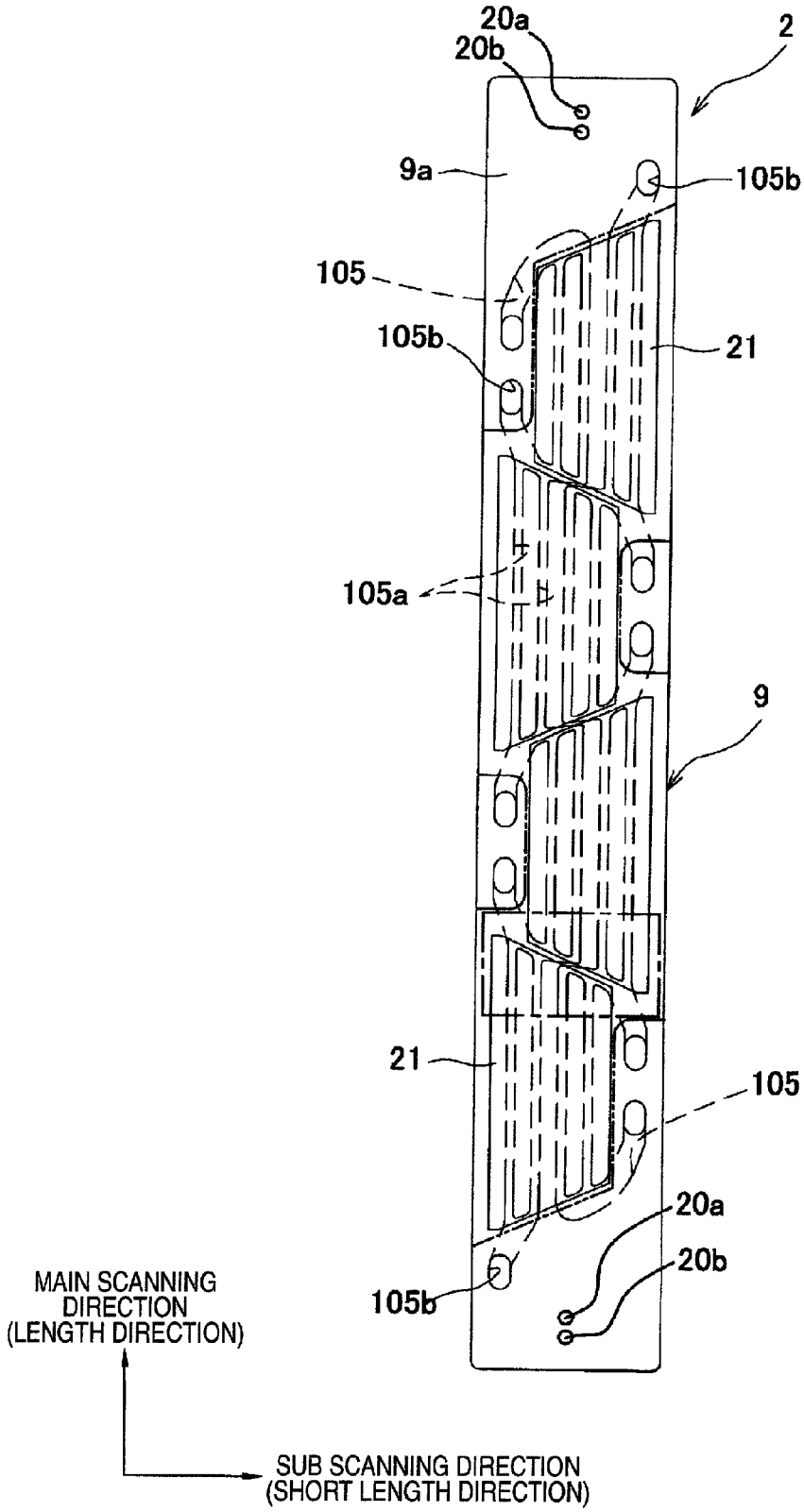
FIG. 2 is a plan view of a head main body shown in FIG. 1.

FIG. 1 is a schematic side view of an inkjet printer 101 according to an exemplary embodiment of the invention. FIG. 2 is a plan view of a head main body shown in FIG. 1. The inkjet printer 101 is a color inkjet printer having four inkjet heads 1 (one example of a recording head) as shown in FIG. 1. The inkjet printer 101 includes a feeder unit 11 at the left of FIG. 1 and a sheet discharge part 12 at the right of FIG. 1.

The inkjet printer 101 includes a sheet conveying path for conveying a sheet P from the feeder unit 11 to the sheet discharge part 12. A pair of conveying rollers 5*a* and 5*b* for conveying the sheet sandwiched therebetween is placed downstream just from the feeder unit 11 in a sheet conveying direction. The pair of conveying rollers 5*a* and 5*b* conveys the sheet P from the feeder unit 11 to the right in the figure. A conveying mechanism 13 is provided in an intermediate portion of the sheet conveying path. The conveying mechanism 13 includes two belt rollers 6 and 7, an endless conveying belt 8 wound so as to be stretched between the belt rollers 6 and 7, and a platen 15 placed in an area surrounded by the conveying belt 8. The platen 15 supports the conveying belt 8 so that the conveying belt 8 does not bend downward at positions opposed to the inkjet heads 1. A nip roller 4 is placed at a position opposed to the belt roller 7. The nip roller 4 presses the sheet P conveyed by the conveying rollers 5*a* and 5*b* from the feeder unit 11 against an outer peripheral surface 8*a* of the conveying belt 8.

A conveying motor (not shown) rotates the belt roller 6, whereby the conveying belt 8 runs. Accordingly, the conveying belt 8 conveys the sheet P pressed against the outer peripheral surface 8*a* by the nip roller 4 to the sheet discharge part 12 while holding the sheet P in an adhesive manner. The conveying belt 8 is formed on the surface with a weakly adhesive silicon resin layer.

A peeling plate 14 is provided downstream from the conveying belt 8 in the sheet conveying direction. The peeling plate 14 is adapted to peel the sheet P adhering to the outer peripheral surface 8*a* of the conveying belt 8 from the outer peripheral surface 8*a* and guide the sheet P to the sheet discharge part 12 at the right from the left in the figure.

The four inkjet heads 1 are fixed along the conveying direction of the sheet P and correspond to four color inks (cyan (C), magenta (M), yellow (Y), and black (K)). In other words, the feeder unit 11 is a line printer. Each of the four inkjet heads 1 has a head main body 2 at the bottom (i.e., facing the conveying belt 8. As shown in FIG. 2, the head main body 2 has an elongated rectangular parallelepiped shape extending in a main scanning direction of a direction orthogonal to the sheet conveying direction. The bottom face of the head main body 2 is an ink ejection face 2*a* opposed to the outer peripheral surface 8*a* of the conveying belt 8. When the sheet P conveyed on the conveying belt 8 passes through the side just below the four head main bodies 2 in order, color ink droplets are ejected from the ink ejection face 2*a* to the top face of the sheet P, namely, a print face. Accordingly, any desired color image can be formed in a print area of the sheet P.

Figure 3:
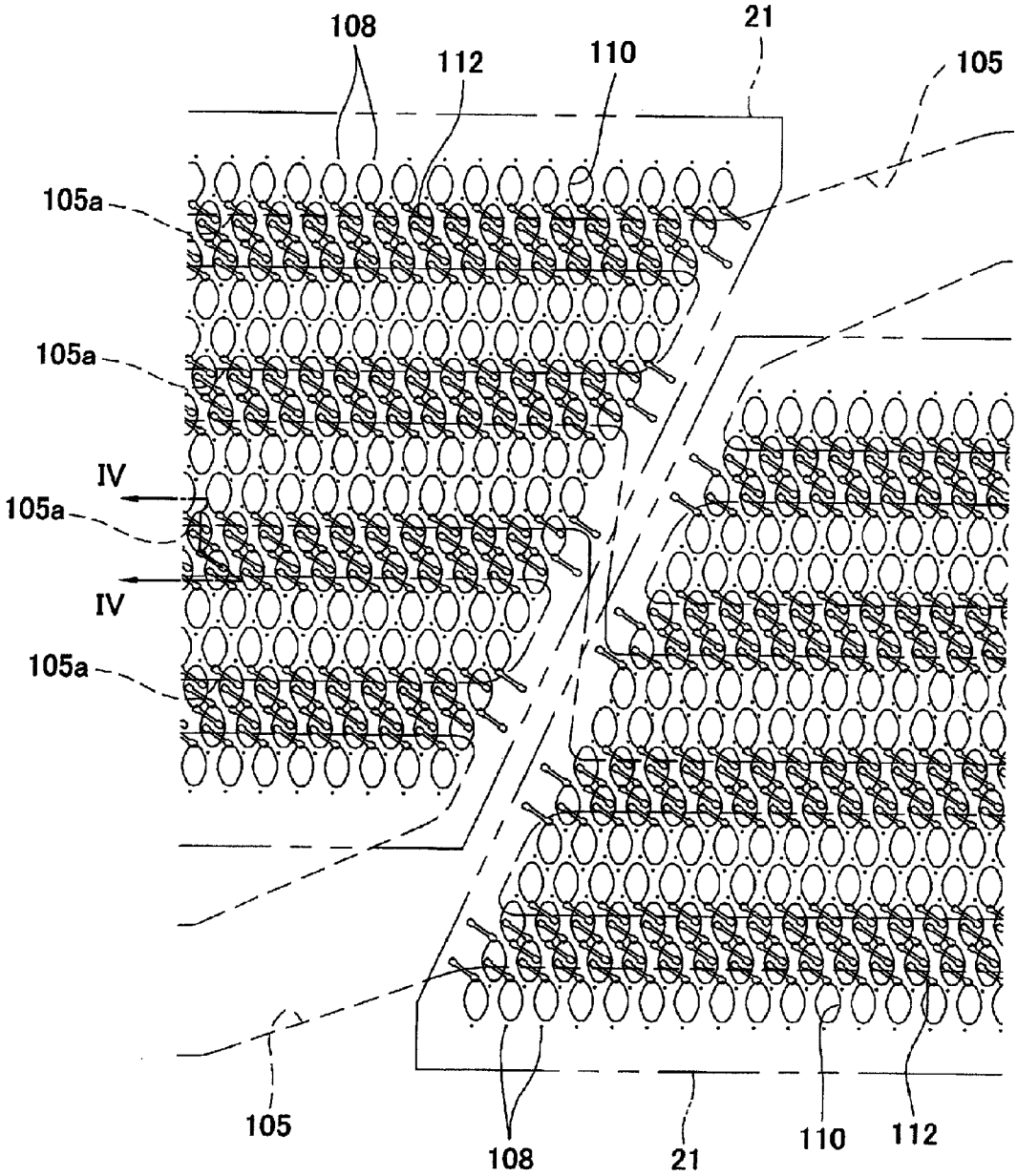
FIG. 3 is an enlarged view of the area surrounded by alternate long and short dash line shown in FIG. 2.
Figure 4:
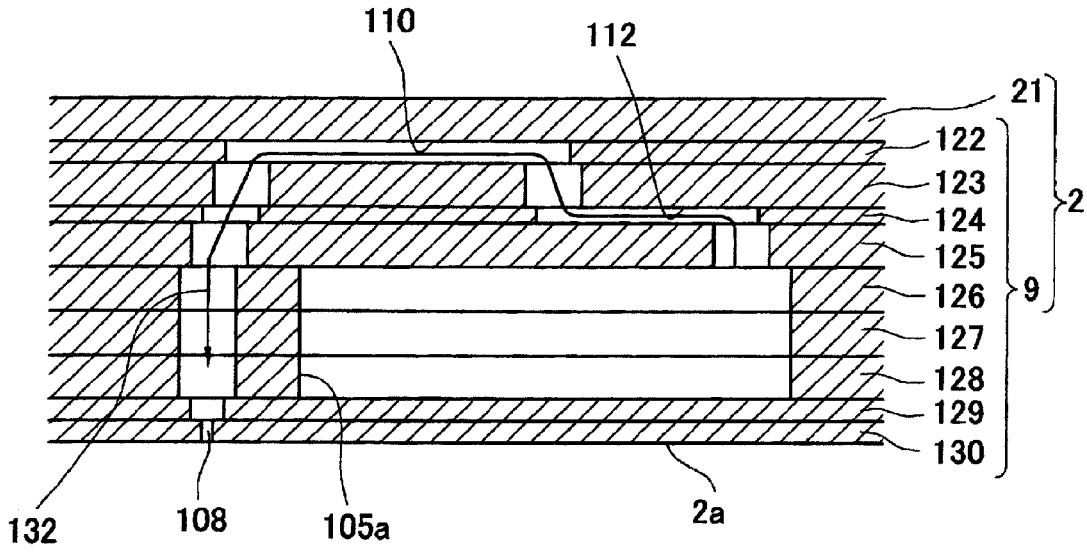
FIG. 4 is a sectional view taken on line IV-IV shown in FIG. 3.
Figure 5:
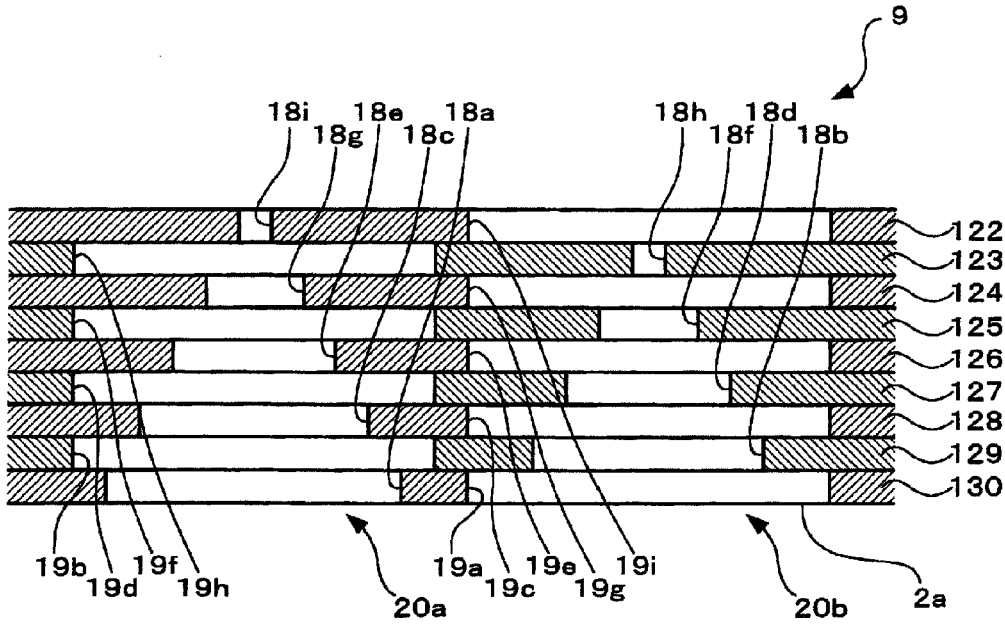
FIG. 5 is a sectional view of a flow path unit close to one end portion thereof shown in FIG. 2.

Next, the head main body 2 will be explained with reference to FIGS. 2 to 5. FIG. 2 is a plan view of the head main body 2. FIG. 3 is an enlarged view of the area surrounded by the alternate long and short dash line in FIG. 2. Note that in FIG. 3, for convenience of the description, pressure chambers 110, apertures 112, and ejection ports 108 in a lower portion of an actuator unit 21 that would usually be drawn by dashed lines are drawn by solid lines. FIG. 4 is a fragmentary sectional view taken on line IV-IV shown in FIG. 3. FIG. 5 is a sectional view of the proximity of one end portion relative to the length direction of a flow path unit 9 (one example of a stacked body).

As shown in FIG. 2, the head main body 2 has four actuator units 21 fixed to a top face 9*a* of the flow path unit 9. As shown in FIG. 3, an ink flow path including the pressure chambers 110, etc., is formed in the flow path unit 9. The actuator unit 21 includes a plurality of actuators corresponding to the pressure chambers 110 and has a function of selectively giving ejection energy to ink in the pressure chamber 110 as the actuator unit is driven by a driver IC (not shown).

As shown in FIG. 2, the flow path unit 9 has a rectangular parallelepiped shape. Ten ink supply ports 105*b* to which ink is supplied are opened in the top face 9*a* of the flow path unit 9. A pair of communicating holes 20*a* and 20*b* piercing the flow path unit 9 is formed in the proximity of each end portion relative to the length direction of the flow path unit 9. As shown in FIG. 5, the communicating holes 20*a* and 20*b* are formed of positioning holes 18*a* to 18*i* and reference holes 19*a* to 19*i* used when plates 122 to 130 forming the flow path unit 9 are stacked. As shown in FIGS. 2 and 3, the flow path unit 9 is internally formed with two manifold flow paths 105 communicating with five ink supply ports 105*b* arranged in the length direction (main scanning direction) of the flow path unit 9 in the proximity of the end portion relative to the short length direction (sub scanning direction) of the flow path unit 9. Each of the manifold flow paths 105 has a plurality of submanifold flow paths 105*a* branching so as to be in parallel and extend in the main scanning direction. The flow path unit 9 is formed on a lower face with the ink ejection face 2*a* where a large number of ejection ports 108 are placed like a matrix (see FIGS. 3 and 4).

As shown in FIGS. 4 and 5, the flow path unit 9 is made up of nine plates 122 to 130 (one example of a plurality of plates) made of a metal material of stainless steel, etc. Each of the plates 122 to 130 has a rectangular plane long in the main scanning direction.

The plates 122 to 130 are stacked on each other and aligned, whereby the through holes formed in the plates 122 to 130 are joined. When the plates 122 to 130 are aligned and stacked together, the two manifold flow paths 105 and a large number of individual ink flow paths 132, each running from the exit of the submanifold flow path 105*a* involved in each manifold flow path 105 via the pressure chamber 110 to the ejection port 108, are formed in the flow path unit 9. The manifold flow paths 105, the submanifold flow paths 105*a* and the individual ink flow paths 132 are one example of a liquid flow path.

A set made up of positioning holes 18*a* to 18*i* and reference holes 19*a* to 19*i* each having a circular opening is formed in the proximity of each end portion relative to the length direction of the plates 122 to 130. The plates 122 to 130 are stacked on each other while they are aligned, whereby the positioning holes 18*a* to 18*i* and the reference holes 19*a* to 19*i* formed in the plates 122 to 130 are placed alternately and concentrically so as to communicate with each other to form communicating holes 20*a* and 20*b*. Specifically, the positioning hole 18*a*, the reference hole 19*b*, the positioning hole 18*c*, the reference hole 19*d*, the positioning hole 18*e*, the reference hole 19*f*, the positioning hole 18*g*, the reference hole 19*h*, and the positioning hole 18*i* are placed alternately and concentrically in order from the plate 130 side (from the lower side in FIG. 5) so as to communicate with each other to form the communicating hole 20*a*. Similarly, the reference hole 19*a*, the positioning hole 18*b*, the reference hole 19*c*, the positioning hole 18*d*, the reference hole 19*e*, the positioning hole 18*f*, the reference hole 19*g*, the positioning hole 18*h*, and the reference hole 19*i* are placed alternately and concentrically in order from the plate 130 side (from the lower side in FIG. 5) so as to communicate with each other to form the communicating hole 20*b*.

In each of the communicating holes 20*a* and 20*b*, the positioning holes 18*a* to 18*i* have opening areas progressively smaller in order from the lower end face of the flow path unit 9 (ink ejection face 2*a*) to the upper end face (the end face opposite to the ink ejection face 2*a*, the top face of the plate 122). All reference holes 19*a* to 19*i* have the same size opening and the same shape. The opening area of each of the reference holes 19*a* to 19*i* is larger than the opening area of each of the positioning holes 18*a* to 18*i*. Thus, in the plan view concerning each of the communicating holes 20*a* and 20*b*, an outline of the positioning holes 18*a* to 18*i* are accommodated in the reference holes 19*a* to 19*i*, and successive ones of the positioning holes 18*a* to 18*i* are accommodated in each other (see FIGS. 11A and 11B).

In the exemplary embodiment, the positioning holes 18*a* to 18*i* and the reference holes 19*a* to 19*i* are positioned on the center line extending in the length direction in the center of the short length direction of the plates 122 to 130, as shown in FIGS. 2 and 5. The positioning holes 18*a* to 18*i* and the reference holes 19*a* to 19*i* forming a set are placed at symmetrical positions with respect to the center of placement of all through holes (all partial flow paths) in both end portions in the length direction in the plates 122 to 130. All through holes are also placed symmetrically with respect to the center of placement thereof. Since the center of placement is positioned on the center line, when the plates 122 to 130 are stacked, the directions of the plates 122 to 130 need not be aligned.

An ink flow in the flow path unit 9 will be explained with reference to FIGS. 2 to 4. Ink supplied to the flow path unit 9 through the ink supply port 105*b* flows into the submanifold flow path 105*a* in the manifold flow path 105. The ink in the submanifold flow path 105*a* is distributed to each of the individual ink flow paths 132 and arrives at the ejection port 108 through the aperture 112 functioning as a diaphragm and the pressure chamber 110. The actuator unit 21 gives ejection energy to the ink in the pressure chamber 110, whereby an ink droplet is ejected from the ejection port 108.

Figure 6:
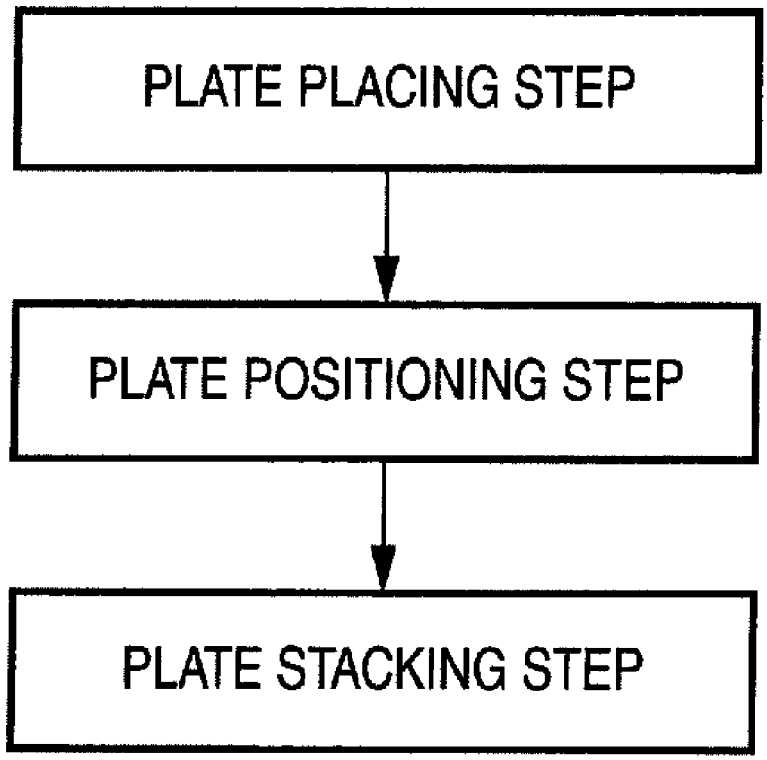
FIG. 6 is a block diagram showing a manufacturing process of the flow path unit shown in FIG. 2.
Figure 7:
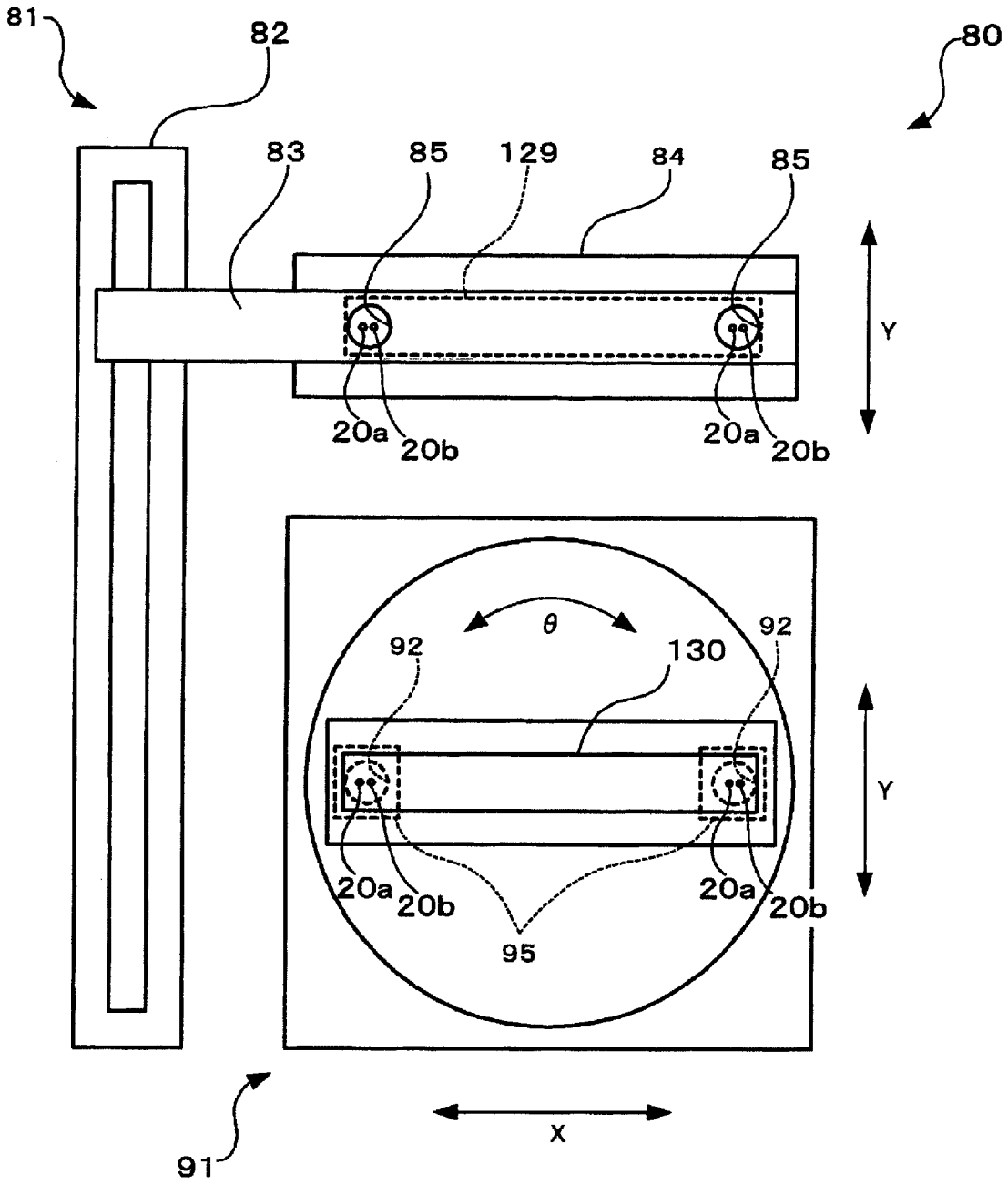
FIG. 7 is a schematic top view of an assembling apparatus used for manufacturing the flow path unit shown in FIG. 2.
Figure 8:
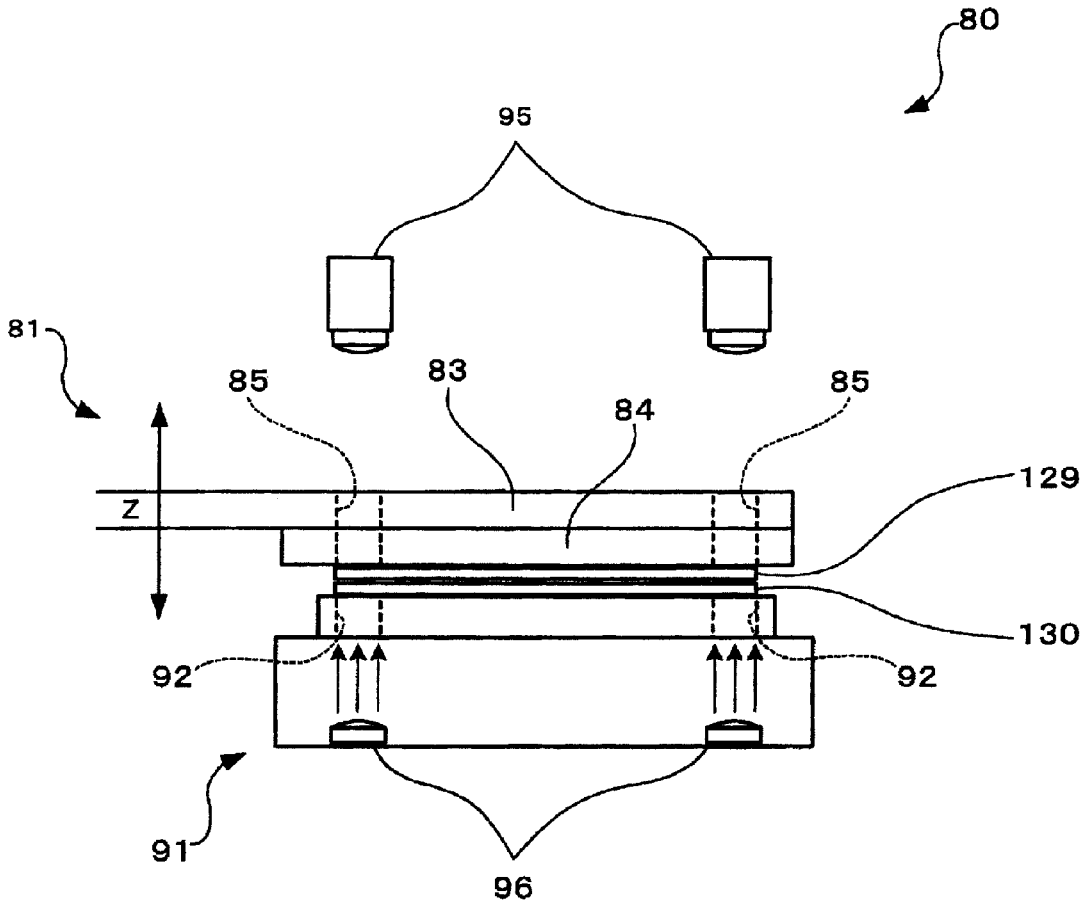
FIG. 8 is a schematic side view of the assembling apparatus shown in FIG. 7.
Figure 9A:
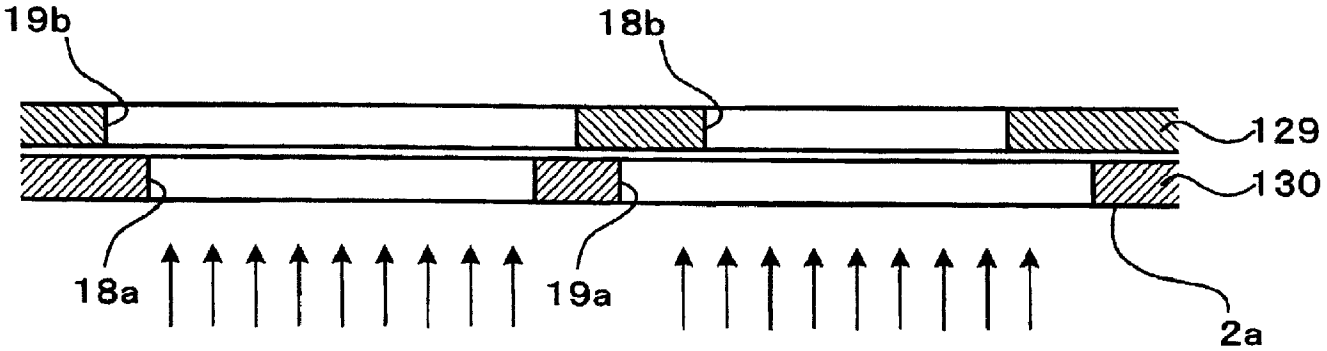
FIGS. 9A and 9B are diagrams showing side and bottom views, respectively, of the flow path unit during the manufacturing process of FIG. 6.
Figure 9B:
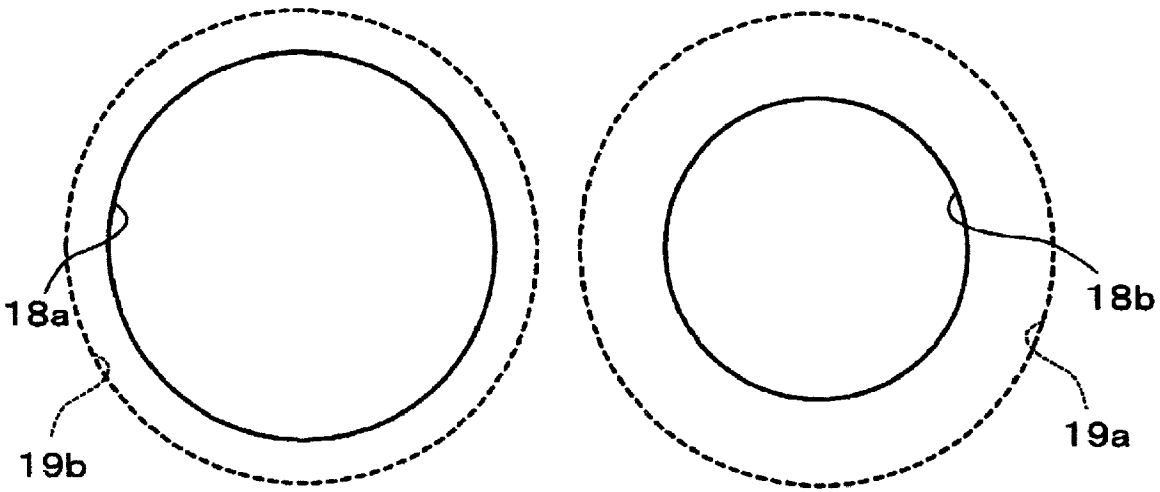
Figure 10A:
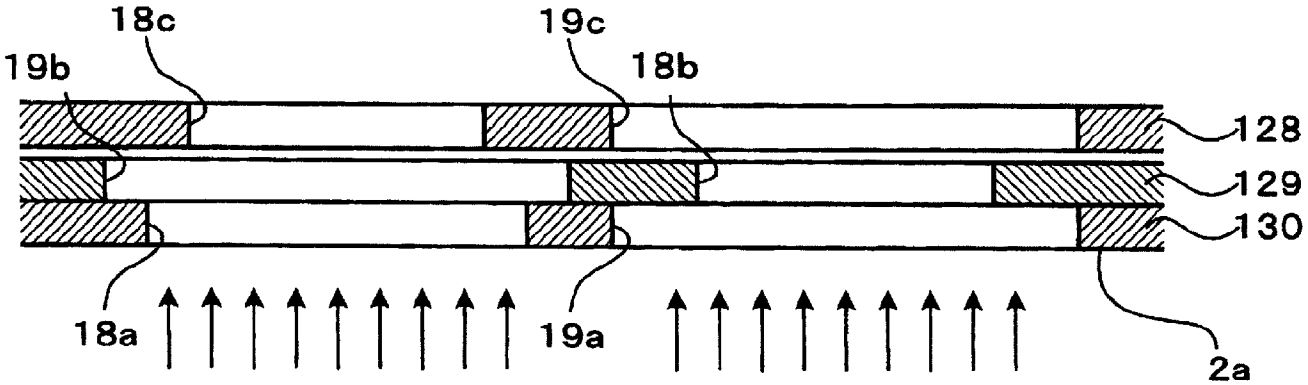
FIGS. 10A and 10B are additional diagrams showing side and bottom views, respectively, of the flow path unit during a later stage of the manufacturing process than those of FIGS. 9A and 9B.
Figure 10B:
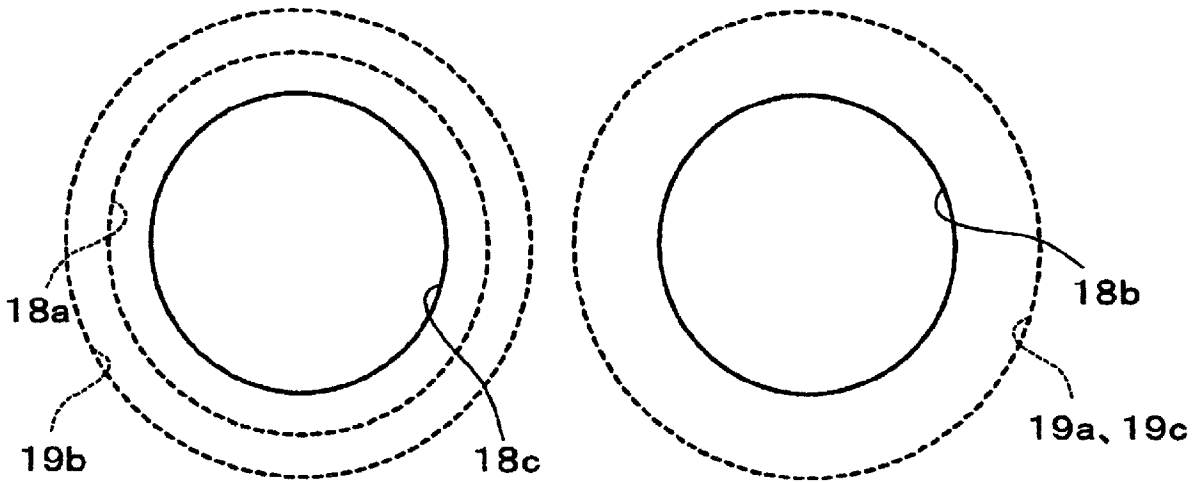
Figure 11A:
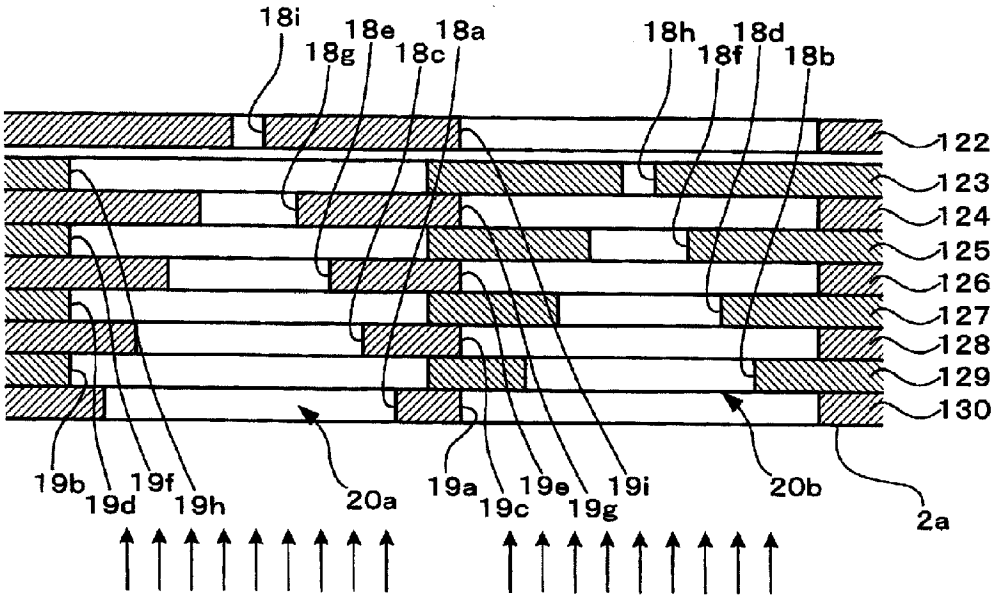
FIGS. 11A and 11B are yet another set of additional diagrams showing side and bottom views, respectively, of the flow path unit during a later stage of the manufacturing process than those of FIGS. 10A and 10B.
Figure 11B:
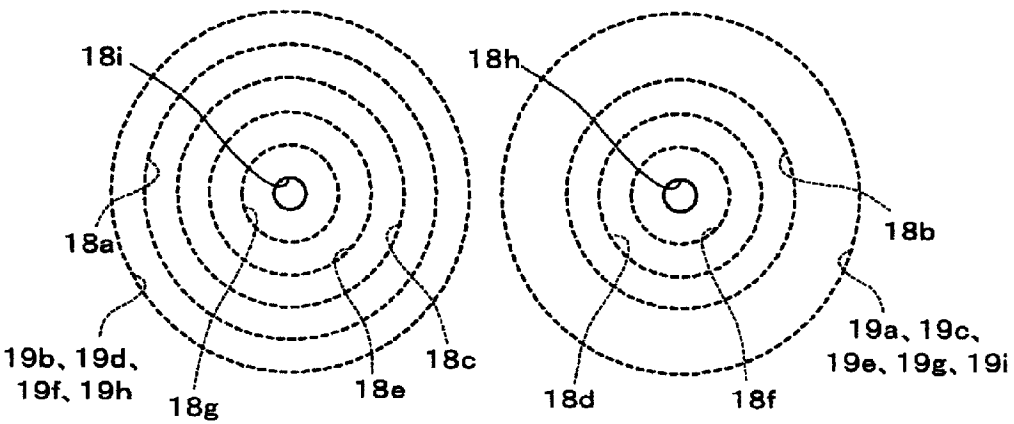

Next, a manufacturing process of the flow path unit 9, of a manufacturing method of the inkjet head 1 will be explained with reference to FIGS. 6 to 11. FIG. 6 is a block diagram to show the manufacturing process of the flow path unit 9. FIG. 7 is a schematic top view of an assembling apparatus 80 used for manufacturing the flow path unit 9. FIG. 8 is a schematic side view of the assembling apparatus 80. FIGS. 9 to 11 are situation drawings to show the manufacturing process of the flow path unit 9. FIGS. 9A, 10A, and 11A are sectional views of the plates 122 to 130 in a plate positioning step. FIGS. 9B, 10B, and 11B are top views of the plates 122 to 130 viewed from a camera 95. Herein, an image of sets of the positioning holes picked up by cameras 95 are drawn by solid lines. FIGS. 9 to 11 show only the set of positioning holes 18*a* to 18*i* and reference holes 19*a* to 19*i* formed in the proximity of one end portion of each of the plates 122 to 130, which is similar to the set of positioning holes 18*a* to 18*i* and reference holes 19*a* to 19*i* formed in the proximity of the opposite one end portion.

As shown in FIG. 6, the assembling step of the flow path unit 9 includes a plate placing step, a plate positioning step, and a plate stacking step performed by the assembling apparatus 80.

First, the assembling apparatus 80 will be explained. As shown in FIGS. 7 and 8, the assembling apparatus 80 includes a plate conveying mechanism 81, a stage 91, two cameras 95, and two lighting fixtures 96. The plate conveying mechanism 81 conveys the plates 122 to 130 one at a time onto the stage 91. The stage 91 can move the plates 122 to 130 stacked in order on the top face in an X direction (right-left direction in FIG. 7), a Y direction (up and down direction in FIG. 7), a Z direction (up and down direction in FIG. 8), and a θ direction (rotating direction of the plane in FIG. 7). The two cameras 95 pick up an image by looking downward from above the stage 91. The two lighting fixtures 96 are opposed to the cameras 95 and apply light upward from below from the inside of the stage 91. In FIG. 7, for convenience of the description, the cameras 95, which would usually be drawn by solid lines, are drawn using dashed lines.

The plate conveying mechanism 81 has a linear actuator 82 extending in the Y direction, an arm 83 extending in the X direction and capable of being moved in the Y direction by the linear actuator 82, and an adsorption pad 84 fixed to the lower end face of the arm 83 for adsorbing and holding the plates 122 to 130. The plate conveying mechanism 81 holds the plates 122 to 130 on the adsorption pad 84 and then moves the arm 83 so as to place the plates 122 to 130 held on the adsorption pad 84 at the stack position above the stage 91.

After each of the plates 122 to 130 held on the adsorption pad 84 is placed at the stack position, the stage 91 moves upward (Z direction), whereby the next one of the plates 122 to 130 in order is stacked on the plate previously stacked on the stage 91.

Each of the arm 83 and the adsorption pad 84 is formed with two through holes 85 opposed to the sets made up of the positioning holes 18*a* to 18*i* and the reference holes 19*a* to 19*i* involved in the plates 122 to 130 held on the adsorption pad 84. On the other hand, the stage 91 is formed with two through holes 92 for allowing light applied from the lighting fixtures 96 to arrive at the cameras 95. When each of the plates 122 to 130 are placed at the stack position by the plate conveying mechanism 81, the two through holes 92 are opposed to the two through holes 85. At this time, the light applied from each lighting fixture 96 passes through the through hole 92 and the through hole 85 and arrives at the corresponding camera 95. Accordingly, the cameras 95 can pick up an image of the sets made up of the positioning holes 18*a* to 18*i* and the reference holes 19*a* to 19*i* of the plates 122 to 130 held on the adsorption pad 84.

Referring again to FIG. 6, in the plate placing step, the plate conveying mechanism 81 places the plates 122 to 130 at the stack position one at a time in the stack order starting at the plate 130 (in the order starting at the plate close to the ink ejection face 2*a*). The plate 130 first placed at the stack position is placed directly on the stage 91 as the stage 91 moves upward along the Z direction.

In the plate positioning step, each time one plate of the plates 122 to 129 (i.e., the second plate or later) is placed at the stack position in the plate placing step, the cameras 95 pick up an image of the sets made up of the positioning holes 18*a* to 18*i* and the reference holes 19*a* to 19*i* of the plate 122 to 129 newly placed at the stack position.

For example, a case where the plate 129 is newly placed at the stack position in the plate positioning step after the plate 130 has been placed on the stage 91 as shown in FIGS. 9A and 9B will be explained. In this case, the opening area of the reference hole 19*b* is larger than the opening area of the positioning hole 18*a*, and the opening area of the reference hole 19*a* is larger than the opening area of the positioning hole 18*b*. Thus, in the plan view shown in FIG. 9B, the reference hole 19*b* of the plate 129 accommodates the positioning hole 18*a* of the plate 130, and the positioning hole 18*b* of the plate 129 is accommodated in the reference hole 19*a* of the plate 130.

Thus, in the plate positioning step, only light passing through the positioning holes 18*a* and 18*b*, of light applied from the lighting fixtures 96 arrives at the cameras 95. Accordingly, the cameras 95 can pack up an image of the two positioning holes 18*a* and 18*b* at the same time. Since the cameras 95 pick up an image of transmitted light, a binarization processing is performed for the picked-up image, whereby the position and the shape of each of the positioning holes 18*a* and 18*b* can be precisely provided. Relative positioning between the plates 129 and 130 is performed by finely adjusting the position of the stage 91 in the X direction, the Y direction, and the θ direction so that the centers of the positioning holes 18*a* and 18*b* in each set are placed in a predetermined positional relationship in the picked-up image. Accordingly, the reference hole 19*b* and the positioning hole 18*a* are placed concentrically and the positioning hole 18*b* and the reference hole 19*a* are placed concentrically.

A case where the plate 128 is newly placed at the stack position in the plate positioning step after the plate 129 has been placed on the plate 130 as shown in FIGS. 10A and 10B will be explained. In this case, the opening area of the reference holes 19*a* and 19*c* is larger than the opening area of the positioning hole 18*b*, and the opening area of the reference hole 19*b* is larger than the opening area of the positioning holes 18*a* and 18*c*. Thus, in the plan view shown in FIG. 10B, the reference holes 19*a* and 19*c* of the plates 128 and 130 accommodate the positioning hole 18*b* of the plate 129, and the positioning hole 18*c* of the plate 128 is accommodated in the positioning hole 18*a* of the plate 130 and the reference hole 19*b* of the plate 129.

Thus, in the plate positioning step, only light passing through the positioning holes 18*b* and 18*c*, of light applied from the lighting fixtures 96 arrives at the cameras 95. Accordingly, the cameras 95 can pack up an image of the two positioning holes 18*b* and 18*c* at the same time. Relative positioning between the plates 128 and 129 is performed by finely adjusting the position of the stage 91 in the X direction, the Y direction, and the θ direction so that the centers of the positioning holes 18*b* and 18*c* in each set are placed in a predetermined positional relationship in the picked-up image. Accordingly, the positioning hole 18*c*, the reference hole 19*b*, and the positioning hole 18*a* are placed concentrically and the reference hole 19*c*, the positioning hole 18*b*, and the reference hole 19*a* are placed concentrically.

Subsequently, a case where the last plate 122 is newly placed at the stack position in the plate positioning step after the plates 123 to 130 have been placed as shown in FIGS. 11A and 11B will be explained. In this case, the opening area of the reference holes 19*a* to 19*i* is larger than the opening area of the positioning holes 18*a* to 18*i*. The opening areas of the positioning holes 18*a*, 18*c*, 18*e*, 18*g*, and 18*i* are larger in order toward the ink ejection face 2*a*. The opening areas of the positioning holes 18*b*, 18*d*, 18*f*, and 18*h* are larger in order toward the ink ejection face 2*a*. Thus, in the plan view shown in FIG. 11B, the reference holes 19*a*, 19*c*, 19*e*, 19*g*, and 19*i* and the positioning holes 18*b*, 18*d*, and 18*f* accommodate the positioning hole 18*h*, and the positioning hole 18*i* is accommodated in the positioning holes 18*a*, 18*c*, 18*e*, and 18*g* and the reference holes 19*b*, 19*d*, 19*f*, and 19*h*. Accordingly, only light passing through the positioning holes 18*h* and 18*i*, of light applied from the lighting fixtures 96 arrives at the cameras 95. Accordingly, the cameras 95 can pack up an image of the two positioning holes 18*h* and 18*i* at the same time.

Relative positioning between the plates 122 and 123 is performed by finely adjusting the position of the stage 91 in the X direction, the Y direction, and the θ direction so that the centers of the positioning holes 18*h* and 18*i* in each set are placed in a predetermined positional relationship in the picked-up image. Accordingly, the positioning holes 18*a*, 18*c*, 18*e*, 18*g*, and 18*i* and the reference holes 19*b*, 19*d*, 19*f*, and 19*h* are placed concentrically and the positioning holes 18*b*, 18*d*, 18*f*, and 18*h* and the reference holes 19*a*, 19*c*, 19*e*, and 19*g* are placed concentrically.

In the plate stacking step, each newly placed plate 122 to 129 positioned in the plate positioning step and the plate of the plates 123 to 130 that is placed just before the newly placed plate are stacked by moving the stage 91 upward along the Z direction.

The plate placing step, the plate positioning step, and the plate stacking step described above are performed for the plates 122 to 130 (the plate 130 is only placed on the stage 91 in the plate placing step) in the stack order starting at the plate 130. After the plate 122 is stacked on the plate 123, the nine plates 122 to 130 are metal-joined. The flow path unit 9 is now complete.

According to the exemplary embodiment described above, relative positioning between two adjacent plates of the plates 122 to 130 is performed based on the center positions of the positioning holes formed in the newly placed plate, provided by picking up an image of the plate newly placed at the stack position while applying upward light of the lighting fixtures 96 to the plates which have already been placed on the stage 91 from below the ink ejection face 2*a*. Thus, the adjacent plates of the plates 122 to 130 can be positioned with high accuracy. Accordingly, the ink flow path can be formed with high accuracy.

Since the set of positioning holes 18*a* to 18*i* and reference holes 19*a* to 19*i* is formed in the proximity of each end portion relative to the length direction of the plates 122 to 130, the adjacent plates 122 to 130 are positioned at two distant points. Accordingly, the positioning accuracy of the plates 122 to 130 can be enhanced and the angle in the plane of the plates 122 to 130 can also be positioned with high accuracy.

Further, the reference holes 19*a* to 19*i* have the same size and the same shape, so that the cost of forming the reference holes 19*a* to 19*i* in the plates 122 to 130 can be reduced.

Although the exemplary embodiments of the invention have been described, the invention is not limited thereto. For example, in the above-described exemplary embodiments, a set of positioning holes 18*a* to 18*i* and reference holes 19*a* to 19*i* is formed in the proximity of each end portion relative to the length direction of the plates 122 to 130. Alternatively, the set of positioning holes and reference holes may be formed at any other location on each plate such as the center of each plate. Additionally, three or more sets of positioning holes and reference holes may be formed in each plate or only one set may be formed. However, if only one set of positioning holes and reference holes is used, the angle in the plane of each plate cannot be determined. Thus, in such a case, it is advantageous for the plates to be stacked using an assembling apparatus for mechanically determining the angle of the plate.

Further, in the above-described exemplary embodiments, the reference holes 19*a* to 19*i* have the same size and the same shape. Alternatively, either the size or the shape of each reference hole may vary from one plate to another as long as the positioning hole positioned downstream relative to the light applying direction can be accommodated in the plan view.

In the above-described exemplary embodiments, the positioning holes 18*a* to 18*i* and reference holes 19*a* to 19*i* have each a circular opening. Alternatively, one or more of the positioning holes and reference holes may have an opening of any other shape such as a rectangle.

In the above-described exemplary embodiments, in the communicating holes 20*a* and 20*b*, the positioning holes 18*a* to 18*h* and the reference holes 19*a* to 19*i* are placed concentrically. Alternatively, each plate may be precisely positioned by placing at least one of the positioning holes and the reference holes at a nonconcentric position.

In the above-described exemplary embodiments, metal joining is adopted for joining after stacking. Alternatively, an adhesive may be used to join the plates together. In this case, an adhesive applying step of applying an adhesive to the joint face of the plates to be stacked is provided before the plate placing step shown in FIG. 6.

In the adhesive applying step, a heat-hardening adhesive is applied to each joint face according to a transfer process. For example, a heat-hardening adhesive is applied onto a lumiler sheet like a film (adhesive support). An adhesive layer is formed in a predetermined thickness with a squeegee. The adhesive applying mechanism may be installed adjacent to the stage 91. In this case, the arm 83 is moved to above the lumiler sheet together with the plates 122 to 129. The joint face of the plates 122 to 129 (transfer face to which the adhesive is transferred) and the adhesive layer are opposed to each other with a predetermined gap. A transfer roller is placed below the lumiler sheet. Further, the transfer roller is moved upward, the lumiler sheet is sandwiched between the transfer roller and the plate 122 to 129, and the transfer roller is moved in parallel along the joint face. Accordingly, the adhesive layer having a given thickness is transferred to the whole joint face of the plates 122 to 129. The plate 130 first placed on the stage 91 is placed directly on the stage 91 without undergoing the applying step.

In addition to the described applying step, the plate placing step, the plate positioning step, and the plate stacking step described above are performed for the plates 122 to 129 in order and a precursor of the flow path unit 9. Further, the precursor is pressurized while the precursor is heated at an adhesive hardening temperature or more, whereby the flow path unit 9 is provided.

According to another aspect of the invention, in the recording head, wherein each of the plurality of plates comprises a plurality of hole sets, each hole set comprising the positioning hole and the reference hole.

According thereto, each of the plates is positioned at two or more points. Therefore, the positioning accuracy can be enhanced and the angle in the plane of the plate can also be positioned with high accuracy.

According to still another aspect of the invention, in the recording head, wherein one hole set of the plurality of hole sets is positioned at one end of the recording head in a length direction thereof, and another hole set of the plurality of hole sets is positioned at the other end of the recording head in the length direction.

According thereto, the plates are positioned at two distant points. Therefore, each of the plates can be positioned still more precisely.

According to still another aspect of the invention, in the recording head, wherein the reference holes have substantially the same size and the same opening shape.

According thereto, the cost of forming the reference holes in the plates can be reduced.

According to still another aspect of the invention, in the method for manufacturing the recording head, wherein the relative positioning between the new plate and the plate placed immediately before the new plate is performed based on a positional relationship between the positioning hole of the new plate and the positioning hole of the plate placed immediately before the new plate.

According to still another aspect of the invention, in the method for manufacturing the recording head, wherein the relative positioning between the new plate and the plate placed immediately before the new plate is performed by aligning the center of the positioning hole of the new plate with the center of reference hole of the plate placed immediately before the new plate, and aligning the center of the reference hole of the new plate with the center of the positioning hole of the plate placed immediately before the new plate.

According to still another aspect of the invention, in the method for manufacturing the recording head, wherein, in the placing step, the plurality of plates are placed such that, in a plan view, the positioning hole of the new plate is accommodated in one or more reference holes and one or more positioning holes of one or more plates placed before the new plate, and the reference hole of the new plate accommodates the positioning hole of the plate placed immediately before the new plate.

What is claimed is:

1. A recording head comprising:

a stacked body comprising:

a liquid flow path;

a plurality of plates stacked on each other; and a communicating hole piercing the stacked body, wherein each of the plurality of plates comprises a cross-sectional portion of the liquid flow path, such that when the plurality of plates are stacked on one another and the liquid flow path is formed, wherein alternate ones of the plurality of plates comprise a reference hole, wherein remaining ones of the plurality of plates comprise a positioning hole, wherein a diameter of each of the references holes are the same, the diameter being larger than a diameter of each of the positioning holes, and the diameters of the positioning holes are successively smaller in order from one side to another side of the stacked body, and wherein when the plates are stacked, the reference holes and the positioning holes of the plates alternate to communicate with each other to form the communicating hole.

2. A recording head comprising:

a stacked body comprising:

a liquid flow path;

a plurality of plates stacked on each other; and two communicating holes piercing the stacked body, wherein each of the plurality of plates comprises:

a cross-sectional portion of the liquid flow path, such that when the plurality of plates are stacked on one another and the liquid flow path is formed;

a positioning hole; and a reference hole, a diameter of the reference hole being larger than a diameter of the positioning hole, wherein locations of the positioning hole and the reference hole of a plate of the plurality of plates correspond to locations of the reference hole and the positioning hole, respectively, of a plate adjacent to the one plate such that, when the plates are stacked, the positioning holes and the reference holes of adjacent plates alternate to communicate with each other so as to form the two communicating holes, the diameters of the positioning holes of the plurality of plates being successively smaller in order from one side to another side of the stacked body relative to a stack direction of the plurality of plates.

3. The recording head according to claim 2, wherein each of the plurality of plates comprises a plurality of hole sets, each hole set comprising the positioning hole and the reference hole.

4. The recording head according to claim 3, wherein one hole set of the plurality of hole sets is positioned at one end of the recording head in a length direction thereof, and another hole set of the plurality of hole sets is positioned at the other end of the recording head in the length direction.

5. The recording head according to claim 2, wherein the reference holes have substantially the same size and the same opening shape.

6. A method for manufacturing the recording head according to claim 2, the method comprising:

a placing step comprising placing a new plate of the plurality of plates;

a positioning step comprising:

applying light through each of the two communicating holes from one side of the stacked body;

picking up the light from the other side of the stacked body to form images of the two communicating holes; and performing relative positioning between the new plate and a plate placed immediately before the new plate based on the images; and a stacking step comprising stacking the new plate on the plate placed immediately before.

7. The method according to claim 6, wherein the relative positioning between the new plate and the plate placed immediately before the new plate is performed based on a positional relationship between the positioning hole of the new plate and the positioning hole of the plate placed immediately before the new plate.

8. The method according to claim 6, wherein the relative positioning between the new plate and the plate placed immediately before the new plate is performed by aligning the center of the positioning hole of the new plate with the center of reference hole of the plate placed immediately before the new plate, and aligning the center of the reference hole of the new plate with the center of the positioning hole of the plate placed immediately before the new plate.

9. The method according to claim 6, wherein, in the placing step, the plurality of plates are placed such that, in a plan view, the positioning hole of the new plate is accommodated in one or more reference holes and one or more positioning holes of one or more plates placed before the new plate, and the reference hole of the new plate accommodates the positioning hole of the plate placed immediately before the new plate.

* * * * *